US006269909B1

(12) United States Patent
Grimes et al.

(10) Patent No.: US 6,269,909 B1
(45) Date of Patent: Aug. 7, 2001

(54) FIBERGLASS EXTENSION LADDER AND METHODS FOR MANUFACTURING THE SAME

(75) Inventors: Ronald R. Grimes, Provo; Kelly E. Rasmussen, Orem; Jack W. Severson, Payson; William R. Isham, Alpine, all of UT (US)

(73) Assignee: FiberLite Technologies, Inc., Pleasant Grove, UT (US)

( * ) Notice: Subject to any disclaimer, the term of this patent is extended or adjusted under 35 U.S.C. 154(b) by 0 days.

(21) Appl. No.: 09/440,387

(22) Filed: Nov. 15, 1999

(51) Int. Cl.[7] ..... E06C 5/04
(52) U.S. Cl. ..... 182/207; 182/129
(58) Field of Search ..... 182/207, 213, 182/129, 107; 248/210

(56) References Cited

U.S. PATENT DOCUMENTS

| | | | | |
|---|---|---|---|---|
| 2,040,977 | | 5/1936 | Carbis | 228/18 |
| 2,388,415 | | 11/1945 | John | 228/66 |
| 2,680,555 | | 6/1954 | Nilsson | 228/66 |
| 2,760,706 | | 8/1956 | Pearl | 228/18 |
| 2,797,038 | | 6/1957 | Tiberghien | 228/66 |
| 3,426,867 | | 2/1969 | Berger | 182/46 |
| 3,464,521 | | 9/1969 | Popoli | 182/207 |
| 3,556,253 | | 1/1971 | Kramer | 182/210 |
| 3,565,211 | | 2/1971 | Le Blanc | 182/211 |
| 3,768,594 | | 10/1973 | Kramer | 182/210 |
| 3,858,684 | | 1/1975 | Goings | 182/207 |
| 3,935,926 | | 2/1976 | Butler | 182/208 |
| 4,222,460 | | 9/1980 | Larson | 182/211 |
| 4,266,631 | | 5/1981 | Larson et al. | 182/211 |
| 4,299,306 | | 11/1981 | Hawkins | 182/210 |
| 4,605,100 | | 8/1986 | Inglese | 182/213 |
| 4,926,964 | * | 5/1990 | Herrin | 182/209 |
| 5,429,207 | | 7/1995 | Frank et al. | 182/209 |
| 5,524,398 | * | 6/1996 | Miller | 182/207 |
| 5,758,745 | | 6/1998 | Beggs et al. | 182/207 |

FOREIGN PATENT DOCUMENTS

| | | | | |
|---|---|---|---|---|
| 2396864 | * | 3/1979 | (FR) | 182/107 |
| 2614931 | * | 11/1988 | (FR) | 182/107 |
| 667504 | * | 3/1952 | (GB) | 182/107 |
| 911299 | * | 11/1962 | (GB) | 182/107 |

* cited by examiner

*Primary Examiner*—Alvin Chin-Shue
(74) *Attorney, Agent, or Firm*—Kirton & McConkie; Michael F. Krieger

(57) ABSTRACT

An extension ladder comprised of a pair of base rails interlocked in a tongue and groove relationship with a pair of slide rails is disclosed. The rails may be manufactured in a variety of shapes including "I" beams, rectangles, boxes, or even ovals or circular shapes. Some embodiments of the ladder include a pulley assembly which is fastened to a fly rail rung and a rope is passed through the pulley to form a continuous loop around the rungs of the base set of rail rungs and the fly fail rungs. In addition, some embodiments include means for attaching tools to the fly rail.

2 Claims, 12 Drawing Sheets

FIBERGLASS EXTENSION LADDER AND METHODS FOR MANUFACTURING THE SAME

BACKGROUND OF THE INVENTION

1. The Field of the Invention

The present invention relates to Fiberglass ladders and to their methods of manufacture. More specifically, the present invention relates to an improved fiberglass extension ladder and methods of fabrication of fiberglass ladders which may be extended in length for utilization at various heights.

2. The Relevant Technology

Ladders are commonly used for a variety of applications and are of two general types; 1) straight extension ladders, and 2) folding ladders, commonly called stepladders, which are self supporting. Extension ladders are typically used where they may be leaned against a structure for support. Such ladders usually include an extensible segment that can be used to telescopically extend the length of the ladder as desired. Straight extension ladders are well-known in the art. Typically, such ladders are constructed so as to provide a stationary rail section, commonly referred to as a base rail, and a slide rail, commonly referred to as a fly rail.

Straight extension ladders of the prior art typically consist of a pair of channeled side rails joined by a plurality of rungs, commonly referred to as stringers. The channels of a base rail typically face inward toward the stringers. The channels of a fly rail typically face outward and away from the stringers. The two rail sections are so designed as to allow one side of the fly rail channel to slideably overlap and interface with one side of the base rail channel in such a manner as to allow free longitudinal movement of the fly rail with respect to the base rail without allowing the two rails to be easily separated laterally. Extension ladders typically employ a pair of rung lock assemblies to secure the fly rail to the base rail at various heights. A cable and pulley assembly is typically employed to assist in the longitudinal movement of the fly rail.

Extension ladders of the prior art are typically made of aluminum or fiberglass channels and aluminum or fiberglass rungs. Because aluminum ladders are electrically conductive, the regulations of the Occupational Safety and Health Administration (OSHA) state that such ladders should not be utilized near live electrical wiring. For this reason, ladders consisting of non-conductive fiberglass side rails are preferred by those who work around electricity.

The channeled configuration of the side rails is particularly susceptible to twisting or deflection when torsion loads are exerted thereon. In the prior art it has been necessary to "beef up" the walls of the channels in order to reduce this torsion weakness. The increased thickness of the walls of the channels increases the amount of material employed and thereby increases the overall weight of the ladder proportionally.

Another problem with extension ladders of the prior art is the restricted useable rung space created by the overlapping relationship between the base and fly rails This overlapping effect is doubled by virtue of the fact that the two rail sections overlap on both sides of the ladder.

Another inherent problem common to overlapping side rails of extension ladders of the prior art is the side-to-side sloppiness in the overlapping union of the fly and base rails. By nature of the construction techniques employed in the mating of the fly rails to the base rails of a conventional extension ladder, the tolerances are extremely broad. This condition allows for a considerable amount of slop or side-to-side lateral displacement between the two rail sections.

Additionally, the looseness of the union between the fly and base rails of an extension ladder as described above, allows considerable flex in the union resulting in a sagging effect that increases dramatically as the ladder is extended to its maximum length. This sagging tendency also concentrates torsion components of a load vector upon the two end points of the intersection between the fly rail and the base rail. This concentrated torsion load tends to spread the sides of each interfacing channel and, when the load exceeds the torsion properties of the material, the union of the two rails is compromised and the ladder collapses. The sloppy side-to-side tolerances, as described above, add to this torsion displacement.

In an effort to minimize the effects of torsion displacement, as described above, those skilled in the art have added rung braces to one or more ends of the base rail. These braces tie the extended portions of the side rails to the adjoining rungs. However, in most cases, the braces are limited to the bottom of the base rails, as having them within the area of transverse motion between the two rails introduces dangerous cutting surfaces for the hands and fingers of the operator. Again, the only option left to mitigate the torsion weakness in the side rails is to "beef-up" the material, thereby increasing the overall weight of the ladder.

Typically, extension ladders of the prior art require heavy duty hardware at the top of the base rail to align and hold together the union of the base rail to the fly rail and reinforce, to some extent, the area of the union when the ladder is extended. This hardware is bulky, has relatively sharp edges, increases the weight of the ladder, is an obstruction to the user and thereby represents a safety hazard.

In an effort to maximize the useable space between side rails those skilled in the art have developed a means by which the fly rail sections of an extension ladder are placed directly on top of the base rails. This technique is commonly referred to as "stacking." Rails joined together in the "stacked" position rely solely upon end braces or brackets to keep them together. This necessitates the utilization of heavy duty braces or brackets to compensate for the lack of interlocking components of the base and fly rails. Although these ladders extend the useable rung space between the fly rails to equal that of the base rails, the union is typically very loose and the hardware relatively heavier than traditional ladders of channeled side rail construction. Extension ladders typically employ a rope and pulley mechanism to assist in the movement of the fly rail relative to the base rail. The rope is usually fastened around the bottom rung of the fly rail and extended between the fly rail rungs and the base rail rungs to one of the uppermost rungs of the base rail. There a pulley is attached and the rope extended through the pulley. The rope is then left to hang along the back side of the ladder behind the base rail rungs. When the fly rail is elevated beyond the first few rungs the rope reaches the ground below and is subject to mud, snow or other natural debris. If, while the ladder is so extended, the operator attempts to move the ladder, he or she runs the risk of stepping on the exposed rope end. As the ladder is then lifted prior to relocation, the captured rope end may convey a movement of the rope through the pulley and to the fly rail assembly. If the action is sufficient to lift the fly rail enough to disengage the rung lock assembly from its union with the base rail, the fly rail is free to fall downward when the rope end is released from its captured position.

These qualities of the rope and pulley combination render their application a hazard and an inconvenience to the operator of the ladder. Also, that portion of the rope that extends from the bottom fly rail rung to the pulley unrestricted in its downward direction. A foot or other object that catches or pushes against that portion of the rope can cause it to pull against the pulley and, if pulled far enough, could cause the rope to be pulled through the pulley and disengage itself from the said pulley. Again, this condition renders the rope a hazard and inconvenience to the operator of the ladder. In addition to the foregoing hazards a conventional rope and pulley present to the operator, the typical method of fastening the rope to the lower fly rail rung represents a further hazard and inconvenience. Typically, the rope is looped around the rung and tied in a knot. This method extends the rope across the stepping surface, thereby presenting an obstacle to the operator. In addition, the looped rope is free to slide to one side of the attachment rung, thereby presenting an unpredictable obstacle to the operator.

An inherent weakness in both aluminum and fiberglass ladders are their susceptibility to bending, denting or crushing along the exposed sections of the side rails when the ladder is "tipped over" or dropped from its standing position. In an effort to mitigate this weakness, those skilled in the art have "beefed up" the material thickness in the exposed areas. Again, however, this adds to the material weight of the resulting ladder.

Unlike step ladders, extension ladders do not possess wide, flat end caps at the top of the ladder to which paint trays or other attachments may be affixed. Those with extension ladders, therefore, are usually attached to the rungs thereof. Such attachments are generally confined to the area of the rungs between the side rails. This places the attachments directly in front of the user and inhibits the use of the rungs thus employed as either a stepping surface or a place for the user to hold on to. As a result, the accessories present an obstruction to the user and thereby create a safety hazard.

SUMMARY AND OBJECTS OF THE INVENTION

It is, therefore, an object of the present invention to provide an all composite extension ladder that is lightweight and non-electrically conductive.

It is another object of some embodiments of the present invention to provide an extension ladder with increased resistance to side-to-side horizontal movement or slop.

It is another object of some embodiments of the present invention to provide an extension ladder with increased resistance to lateral movement or sag between the base and fly rails.

It is yet another object of some embodiments of the present invention to provide an extension ladder that increases strength in the union of the fly rail to the base rail.

It is still another object of some embodiments of the present invention to provide an extension that reduces the need for braces, brackets or other hardware related to the union of the base rails to the side rails.

It is an additional object of some embodiments of the present invention to provide an extension ladder that maximizes the useable rung space between fly rails.

It is a further object of the present invention to provide an extension ladder that reduces hazards and increases the safety to its user.

It is yet another object of some embodiments of the present invention to provide an extension ladder that reduces the vulnerability of the exposed areas of the side rails to damage caused by being tipped over or dropped from its standing position.

A still further object of some embodiments of the present invention is to provide an extension ladder that include a means for applying various attachments directly to the side rails of the ladder.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

To achieve the foregoing objects, and in accordance with the invention as embodied and electrically conductive. This is achieved in part by constructing the ladder of pre-stressed filament wound fibers which are integrated into a resin matrix binder to form a strong composite material. Additional advantages are achieved by constructing the ladder with rungs which are also constructed of a fiber/resin material.

As discussed above, those skilled in the art have encountered several significant problems in constructing a lightweight, non-conductive extension ladder according to the prior art methods. Some features which may significantly contribute to the strength of some embodiments of the present invention are: (1) the stacking of the box fly rail directly on top of the base rail, (2) an interlocking tongue and groove union between the base and fly rails, (3) a dual purpose impact absorption and accessory attachment rail edge and, (4) a continuous feed rope and pulley. Stacking the box fly rail directly on top of the box allows the fly rail to be the same width as the base rail and also allows the fly rail rungs to be the same length as the base rail rungs. This arrangement maximizes the useable rung space on the fly rail while minimizing the overall width of the ladder.

An interlocking tongue and groove arrangement is employed between the fly rail and the base rail. The fly rail is generally rectangular with an interlocking tongue formed on the rear face thereof. The mating base rail is also generally rectangular with an interlocking groove formed on the front thereof. The tongue of the fly rail is inserted into either end of the base rail and is thereby slideably attached. Torsion loads exerted upon either the fly rail or the base rail are absorbed by the interlocking tongue and groove union and are thereby distributed along the entire length of the intersecting surfaces. In this manner the strength of the union is greatly multiplied in the most critical area of stress. In order for the fly rail to be dislodged from the base rail in either plane perpendicular to the longitudinal axis of the side rail assembly, either the expanded end of the tongue or the mating ridges of the groove or both would have to be sheared or torn from its respective rail. In this manner the torsion loads thus exerted upon the union are transferred into the tensile strength of the fibers and matrix of the fly and base rails collectively. Inasmuch as the tensile strength of fiberglass is many times that of its torsion strength, the union of the fly rail to the base rail by means of an interlocking tongue and groove is also many times that of overlapped channel side rails or stacked "I" beam side rails that are held together with braces. For this reason, ladders of the present invention require neither braces, brackets nor guides to support or stabilize the union of the fly rail to the base rail.

The present invention comprises a dual purpose impact absorption and accessory attachment rail edge. It has been observed during extensive test procedures that the exposed outer edges of the rail sections of both aluminum and fiberglass extension ladders are particularly susceptible to damage resulting from the ladder being tipped over or otherwise dropped from its standing position. When striking a raised surface, such as a curb or large rock, aluminum side rails are severely bent or dented. Fiberglass ladders suffer crushed fibers and resin in the areas of impact. When fiberglass ladders of the present invention are dropped against either the tongue or groove portions of the side rails, damage is resisted. The design of the tongue portion creates a baffle that acts as a shock absorber at the area of impact. The opened edge of the grooved portion of the tongue and groove assembly renders the side edges of the groove capable of flexing inward towards the groove, thereby affording the same shock absorption properties as the tongue portion.

The incorporation of either a tongue or groove style configuration along the outer edges of the side rails serves to inhibit structural damage caused by impact along those edges. In addition, the incorporation of either a tongue or groove style configuration along the outer edges of the side rails provides a means for attaching accessories directly to the side rails. A lockable edge is incorporated along the mating edge of an accessory that interfaces with the tongue or groove in such a manner as to allow it to be insertably joined to the corresponding side rail section and lockably affixed thereto.

A continuous feed rope and pulley arrangement is applied to the current invention. By looping the loose end of the rope that hangs down along the back side of the base rail assembly under the bottommost base rail rung and attaching said rope end to the bottommost fly rail rung, where the opposite end of the rope is already attached, the slack in the said rope is taken up as the rope is pulled downward to elevate the fly rail. This precludes the loose end of the rope from dangling down to the ground where it may become polluted with mud, snow or other pollutants, enabling the become dislodged from its mated pulley or being stepped on by the operator of the ladder.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
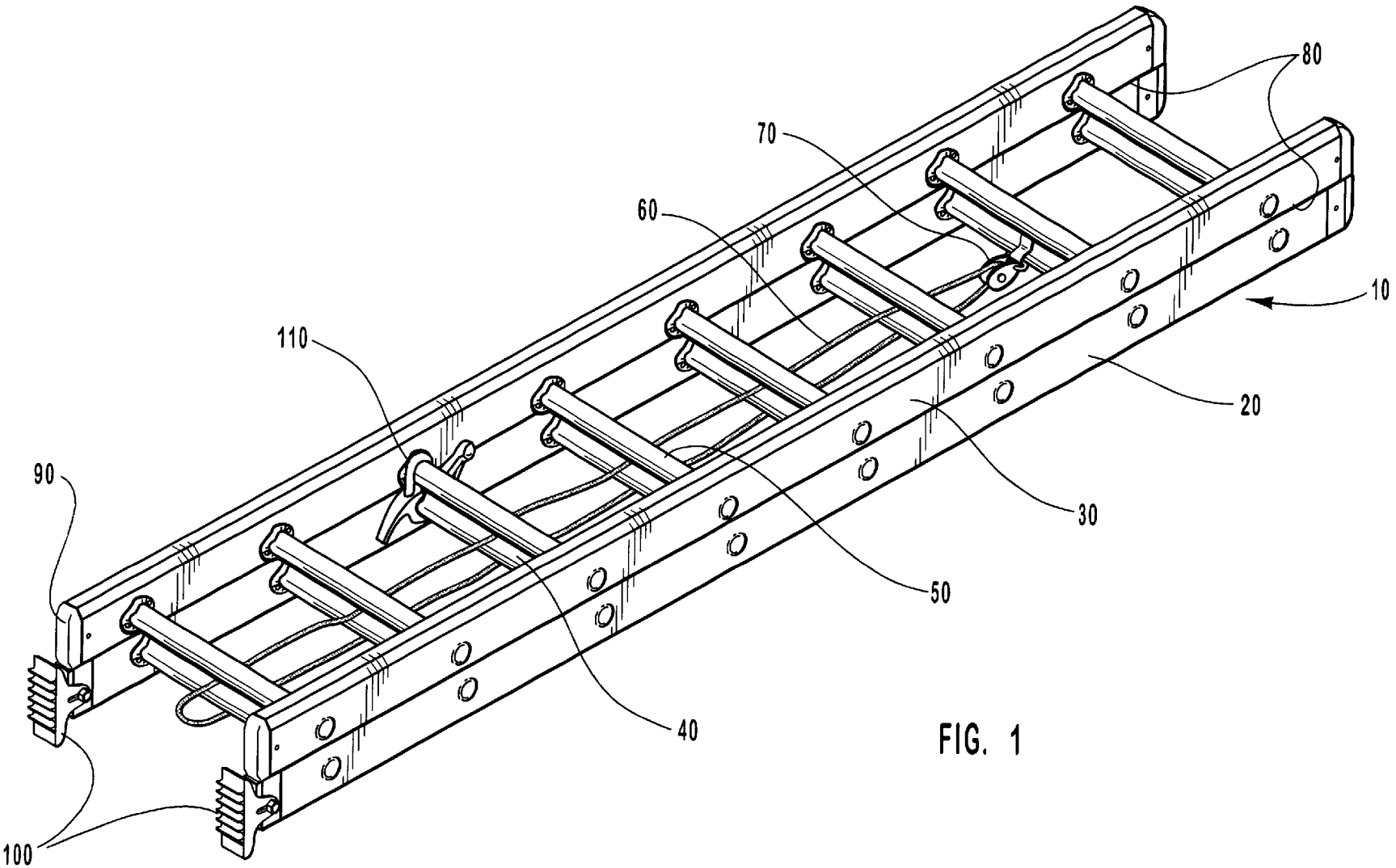
FIG. 1 is a perspective view of a straight extension ladder.

The invention is best understood by reference to the drawings wherein like parts have like numerals throughout. Although the embodiments and method of manufacture of the present invention discussed herein are that of a fiberglass extension ladder, it will be appreciated that the structure and method of manufacturing disclosed may be applied to other types of ladders made of composite materials, such as combination step and extension ladders. FIG. 1 depicts a straight extension ladder shown generally as 10. The extension ladder generally comprises two rail assemblies, a stationary or "base" rail assembly, comprised of two base rails 20 joined together by a multiplicity of rungs or "stringers" 40 and a moveable or "fly" rail assembly, comprised of two fly rails 30 joined together by a multiplicity of stringers 50. Typically, extension ladders include a pair of rail locks 110 and impact and abrasion resistant bumpers or feet 120 located at both ends of each base and fly rail. Also typically included is a rope and pulley assembly, consisting of a rope 60 and a pulley assembly 70. The present invention incorporates an interlocking tongue and groove union 80 between both sets of base and fly rails. Fly rail 30 is capable of slideably extending along the longitudinal axis of ladder 10. Rung lock 110 is capable fly rail 30 in various positions relevant to base rail 20. When engaged in the locked position, base rail rungs 40 and fly rail rungs 50 are co-planer; that is, the stepping surfaces of each fly rail rung 50 is so aligned with the stepping surfaces of each base rail rung 40 as to lie in the same plane with each other.

Figure 2A:
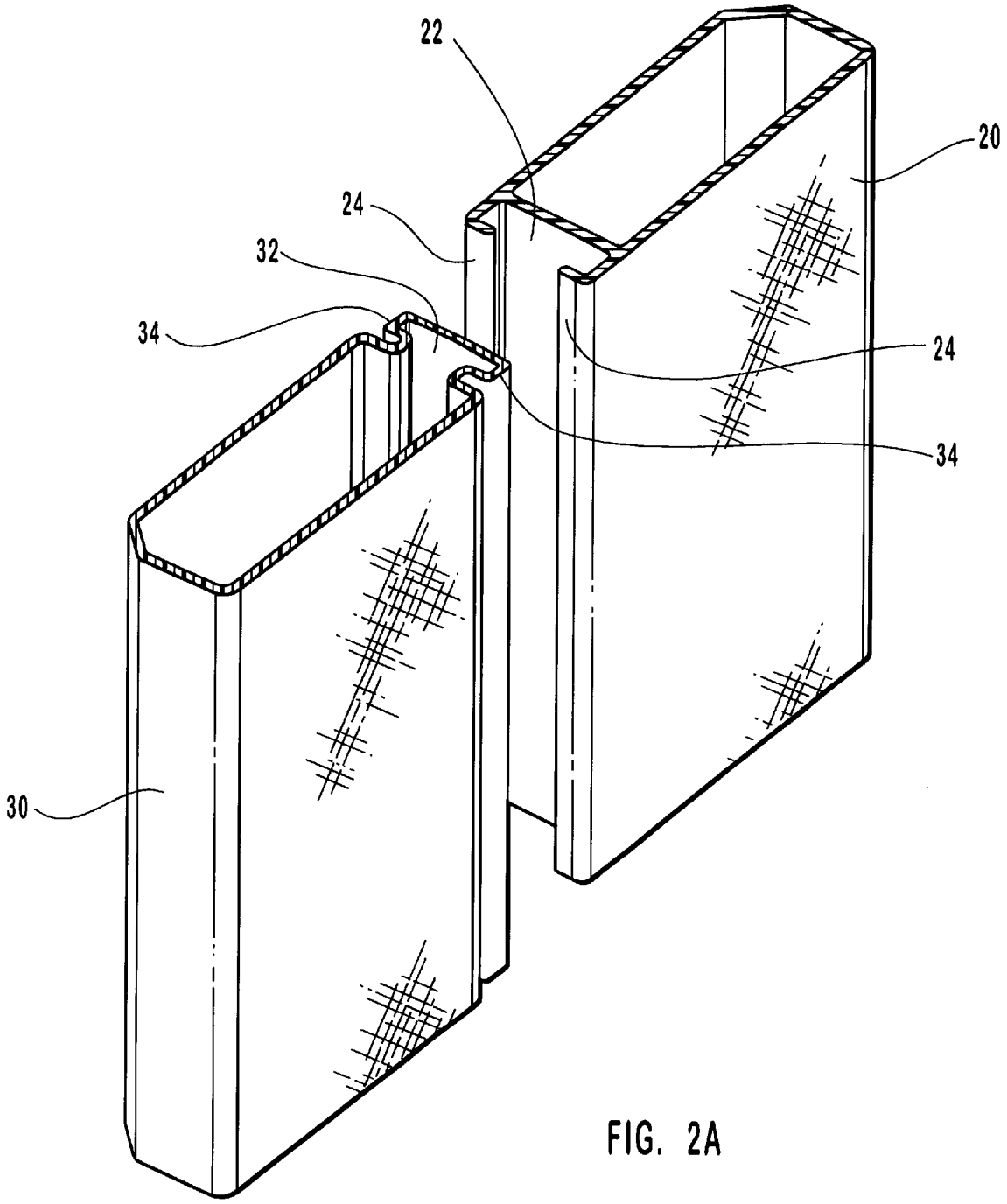
FIG. 2A is a sectional view of an interlocking tongue and groove.

FIG. 2A illustrates a section of base rail 20 as it relates to fly rail 30. Base rail 20 generally consists of a rectangular section with a groove 22 formed in one face of the rectangle. Fly rail 30 generally consists of a rectangular section with a mating tongue 32 formed in one face of the rectangle. Tongue 32 of fly rail 30 is so designed as to allow it to slideably enter into the groove portion 22 of base rail 20 from either end. Tolerances are such that the motion of fly rail 30 in relation to base rail 20 affords a minimal amount of drag and slop (side-to-side movement).

Flanged portion 34 of fly rail 30 interlocks with the ridge portions 24 of base rail 20 in such a manner as to prohibit disengagement of the fly rail from the base rail in a lateral direction.

Figure 2B:
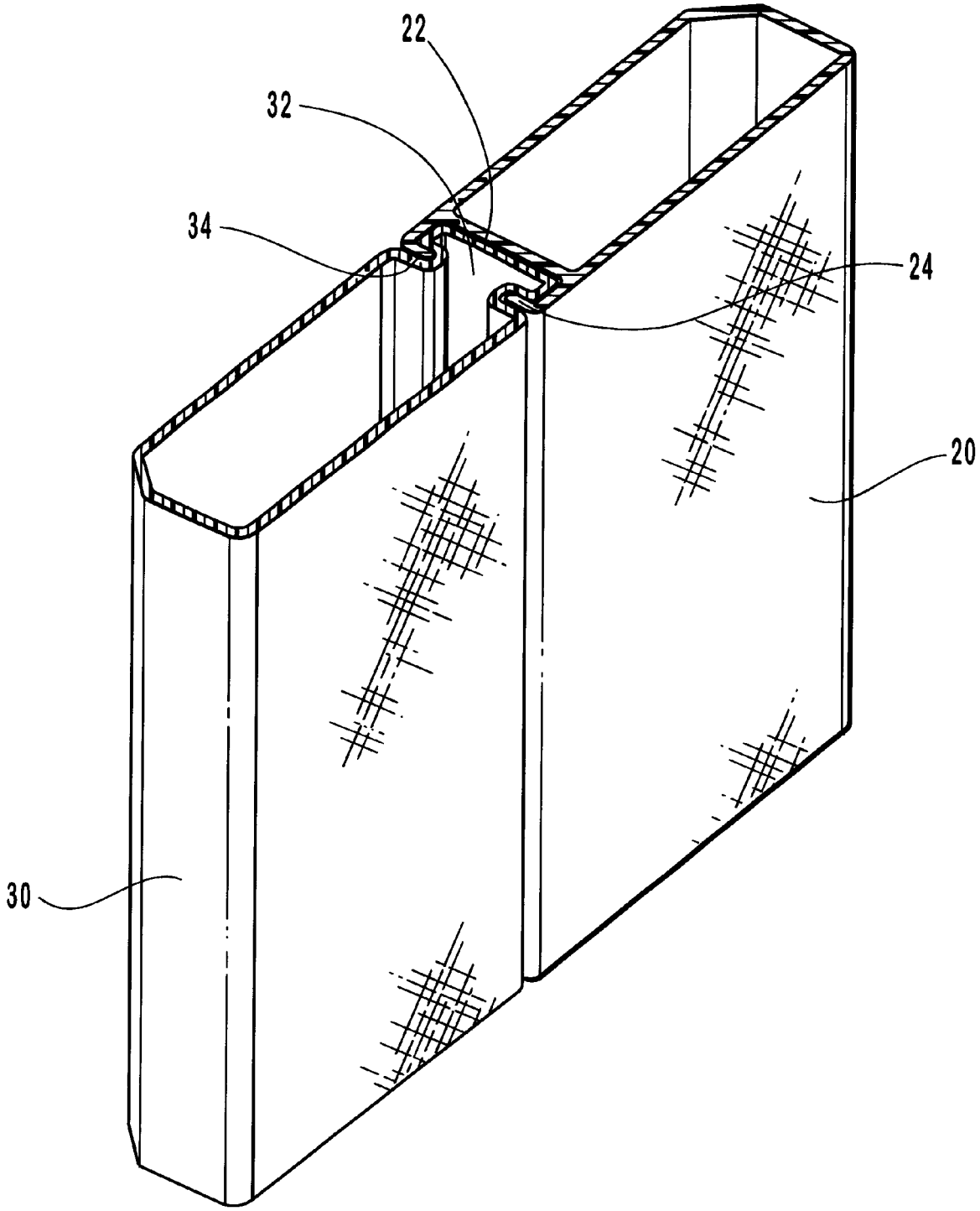
FIG. 2B is a sectional view of an interlocking tongue and groove.

FIG. 2B illustrates a section of fly rail 30 engaged with a section of base rail 20 in an interlocked position. The flange portion 34 of fly rail tongue 32 interfaces with the tongue portion of base rail 20 and cannot be laterally dislodged without tearing either the flange portion 34 completely from tongue 32 or tearing ridge portions 24 from groove 22, or both. Thus, the fly rail is captivated in the lateral plane while slideably mobile in the longitudinal plane.

The process of bias winding glass filaments, impregnated with a suitable matrix binder (resin) and pre-stressing the filaments during the curing process of the matrix is utilized. Glass filaments, impregnated with a matrix binder are wound around a mechanically expandable/retractable mandrel. When the prescribed thickness of resin impregnated fabric is thus woven upon the mandrel, the entire assembly is placed within a mold, the mold clamped and the mandrel expanded within the mold. A nominal stress load is thus exerted upon the fibers to remove the elasticity contained therein as excess resin is forced out of the fabric and deposited along the outer face of the winding. This creates a resin rich surface that is particularly suitable for surface impressions including texturing. When the resin is cured, the winding assembly is removed from the mold and the center mandrel is mechanically retracted so as to allow it to collapse within the molding and facilitate easy removal from the part. This process is equally applicable both the side rail and composite rung construction.

In an alternate embodiment, base rail 20 and fly rail 30 are fabricated using the process of pultrusion, a process familiar to those skilled in the art. In this process, glass filaments, saturated with an appropriate matrix binder, are longitudinally pulled over a hot sprue and through a forming die. In some applications, layers of pre-woven fabric are added to the pultrusion process to meet definition and surface quality requirements. In other applications, chopped fibers, saturated with a matrix binder, are sandwiched between layers of pre-woven fabric and are then pulled over a hot sprue and forming die.

In the pultrusion process both the sprue and forming die may be so designed as to modify the configuration of the fabric to virtually any shape desired continuous and reduces handling to a minimum. For these and other reasons, pultrusion is preferred method for fabricating the present invention.

Figure 3A:
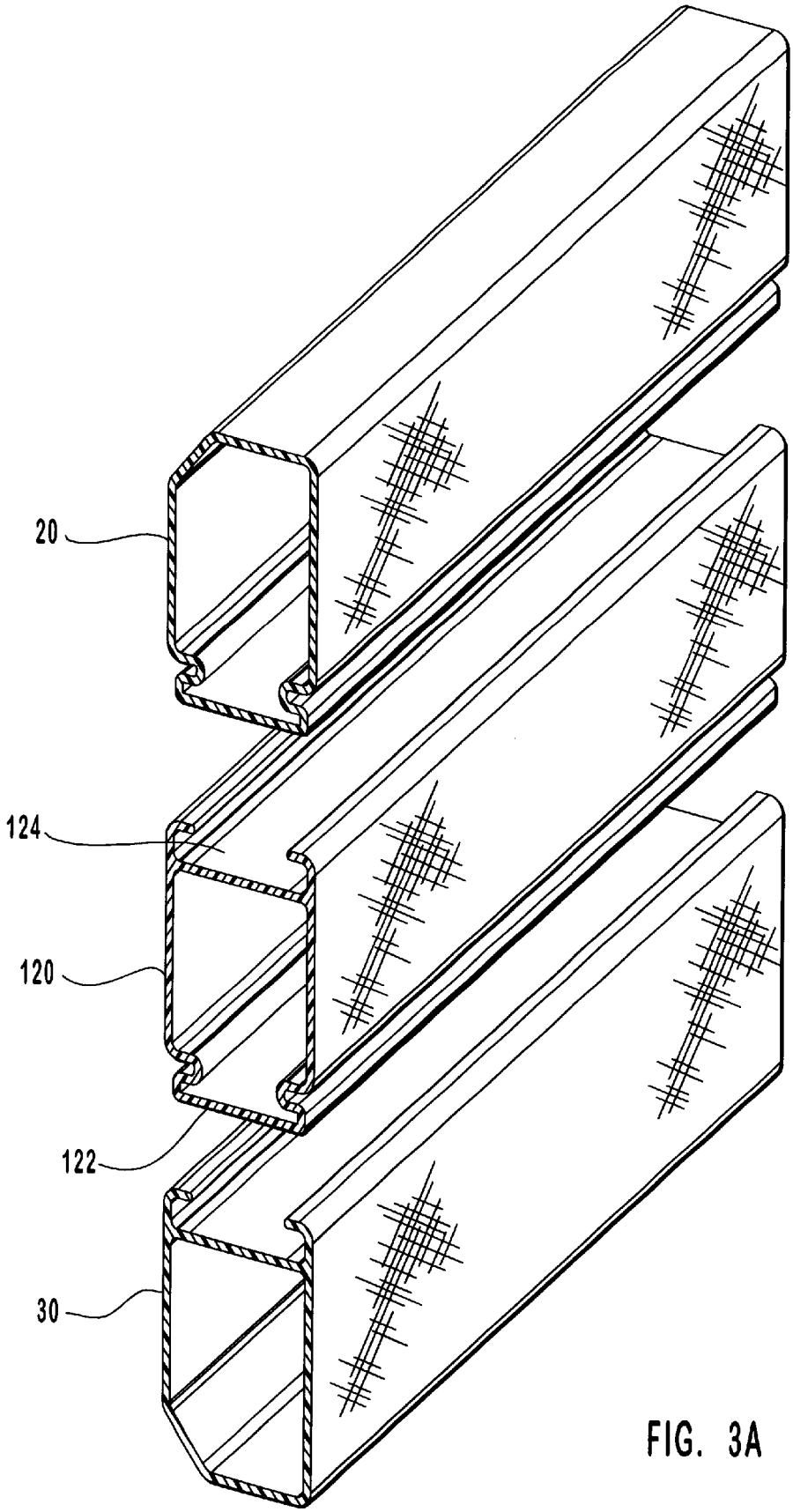
FIG. 3A is a sectional view of an interlocking tongue and groove.
Figure 3B:
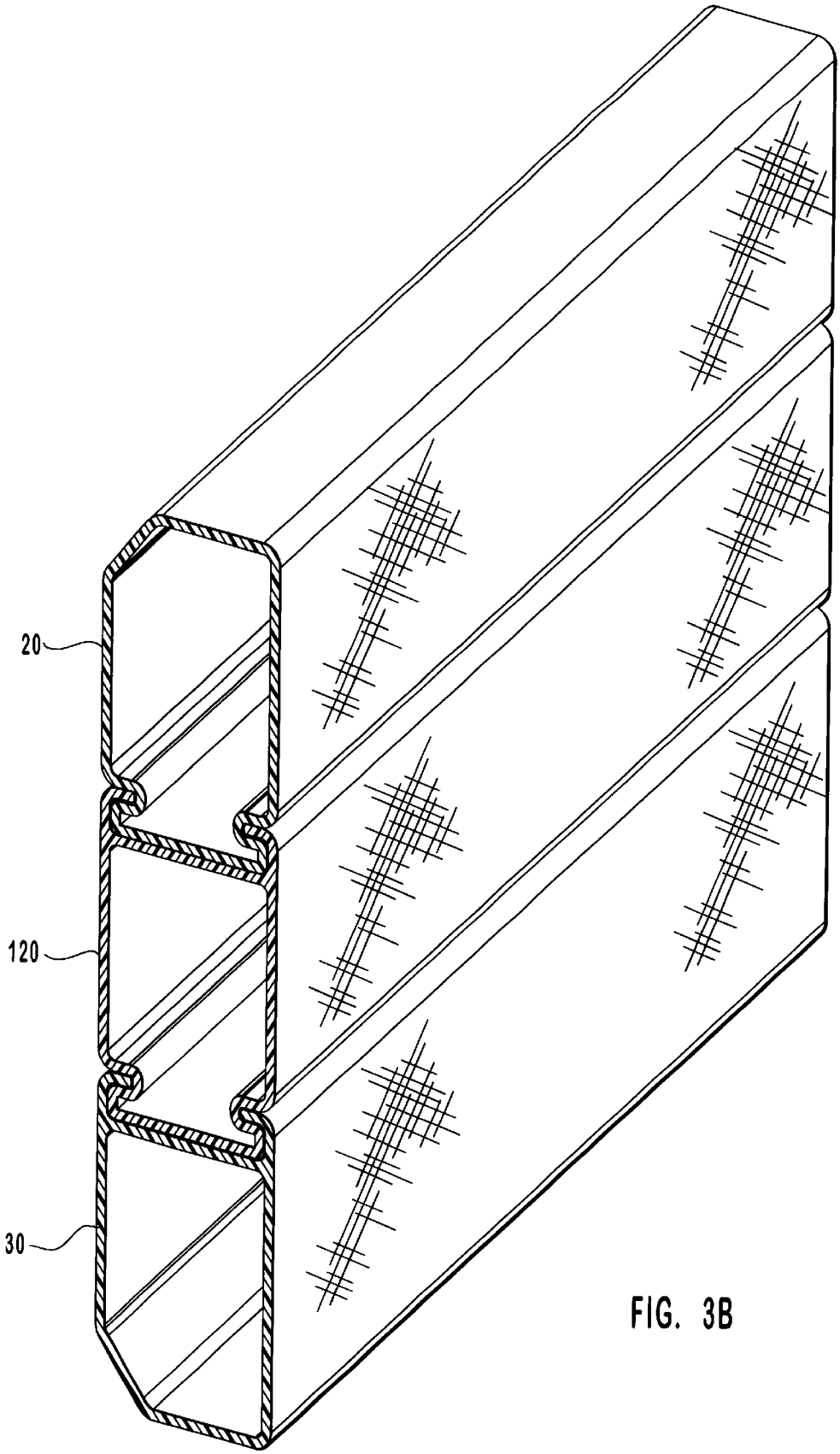
FIG. 3B is a sectional view of an interlocking tongue and groove.

FIG. 3A illustrates another alternate embodiment, wherein the arrangement is extended to more than two box rail sections. Herein base rail 30 and fly constructed as to receive center rail tongue 122 and center rail groove 124 respectively. Again, center rail 120 is generally in a rectangular form with both tongue 122 and groove 124 formed in opposing faces. FIG. 3B illustrates the manner in which base rail 30, center rail 120 and fly rail 20 are assembled. It can be appreciated, however, that the arrangement of tongues and grooves may be varied without affecting the basic concept of interlocking tongues and grooves. For example, center rail 120 may be formed with two tongues or two grooves as long as the corresponding base and fly rails include the respective mating configuration.

Figure 4A:
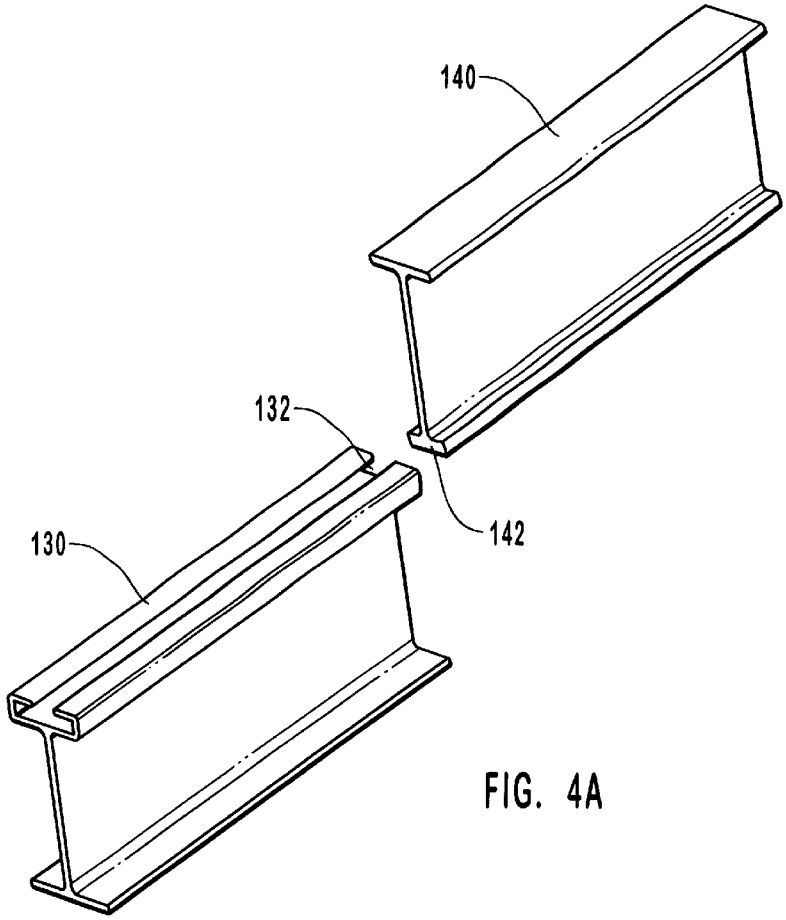
FIG. 4A is a sectional view of an interlocking tongue and groove.

FIG. 4A illustrates another alternate embodiment within the scope of the present invention. Herein base rail 130 represents an "I" beam construction with groove 132 formed within one face of the "I". Fly rail 140 consists of an "I" beam construction with tongue 142 formed within the mating face with respect to base rail 130.

Figure 4B:
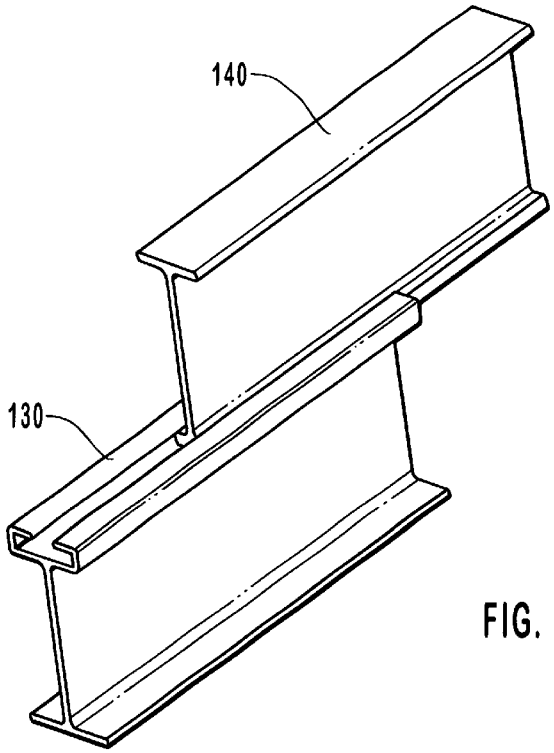
FIG. 4B is a sectional view of an interlocking tongue and groove.

FIG. 4B illustrates the manner in which base rail 130 and fly rail 140 are assembled. As so assembled, base rail 130 and fly rail 140 are slideably attached allowing free longitudinal movement between the said rails without allowing them to disengage laterally.

Figure 4C:
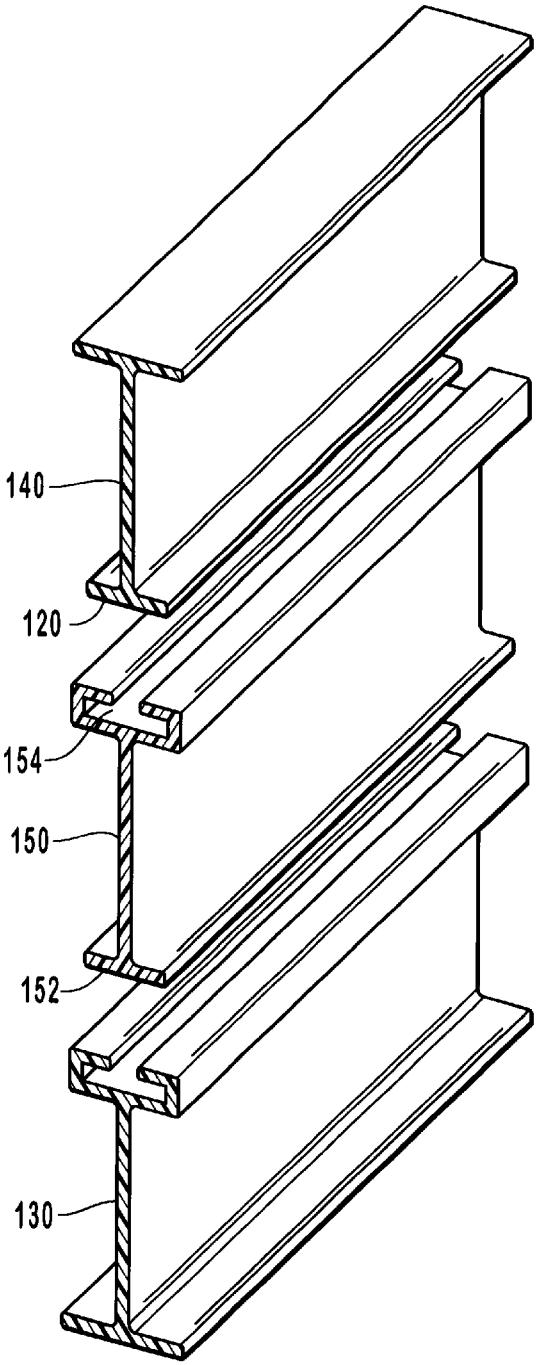
FIG. 4C is a sectional view of an interlocking tongue and groove.
Figure 4D:
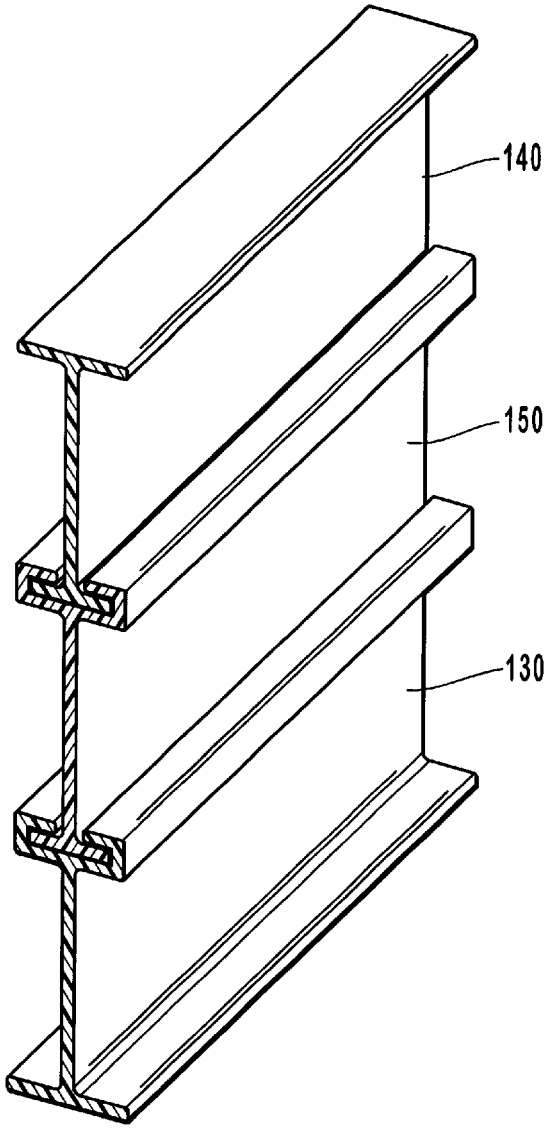
FIG. 4D is a sectional view of an interlocking tongue and groove.

FIG. 4C illustrates another alternate embodiment within the scope of the present invention wherein the tongue and groove arrangement is extended to more than two "I" beam constructed side rails. Herein base rail 130 and fly rail 140 are so constructed as to receive center "I" beam rail tongue 152 and center rail groove 154 of center rail 150 respectively.

FIG. 4C illustrates the manner in which base "I" beam rail 130, center "I" beam rail 150 and fly "I" beam rail 140 are assembled. Again, it can be appreciated that the arrangement of tongues and grooves may be varied without affecting the basic concept of interlocking tongues and grooves.

Figure 5A:
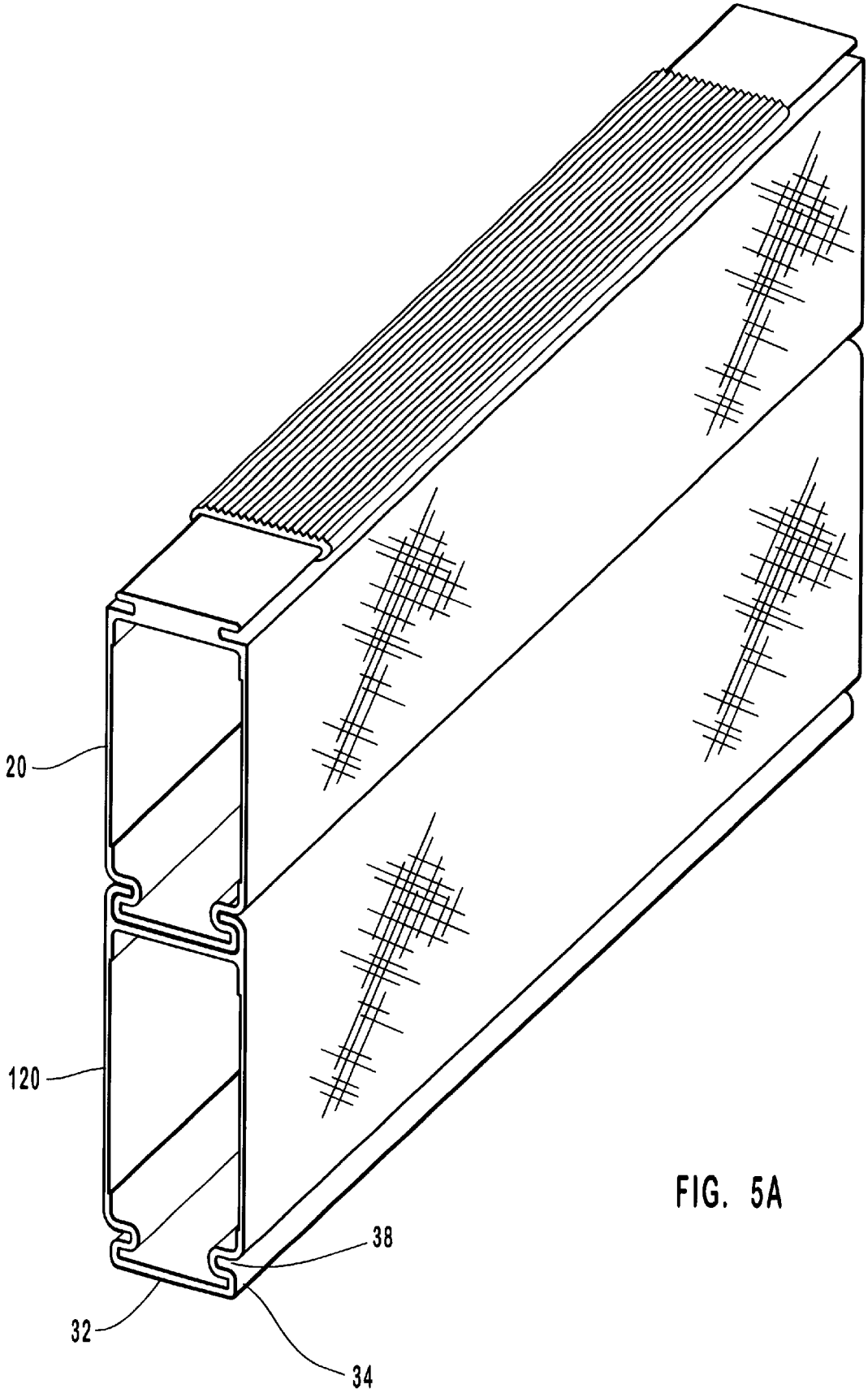
FIG. 5A is a perspective view of an interlocking tongue and groove with shock absorption tongues and abrasion resistant accessory.

FIG. 5A illustrates a tongue and groove assembly that incorporates additional tongues added to the outer edges of each side rail and an abrasion resistant strip attached to one of the outer tongues. Although only tongues are herein added, it will be appreciated that the substitution of grooved sections in place of the illustrated outer tongues is equivalent in both function and purpose. The configuration of tongue 32 creates baffle 36 that functions as a shock absorber when the ladder is dropped upon a localized area, such as a curb or large rock. As a force is directed against tongue 32, tongue recesses 38 enable tongue 32 to flex inward toward the main body of fly rail 30 thereby employing the flexural properties of the glass and matrix binder.

As the force is released, the flexural properties of the glass and matrix binder return the tongue to its relaxed position. In similar fashion the ridged portions 24 (not shown) of base rail groove 22 (see FIG. 2B) flex inward toward the main body of base rail 20. Again, the flexural properties of the glass and matrix binder allow flanged portions 24 to compress and absorb the pressure of impact and then return to its relaxed state when the pressure of impact is released.

Figure 5B:
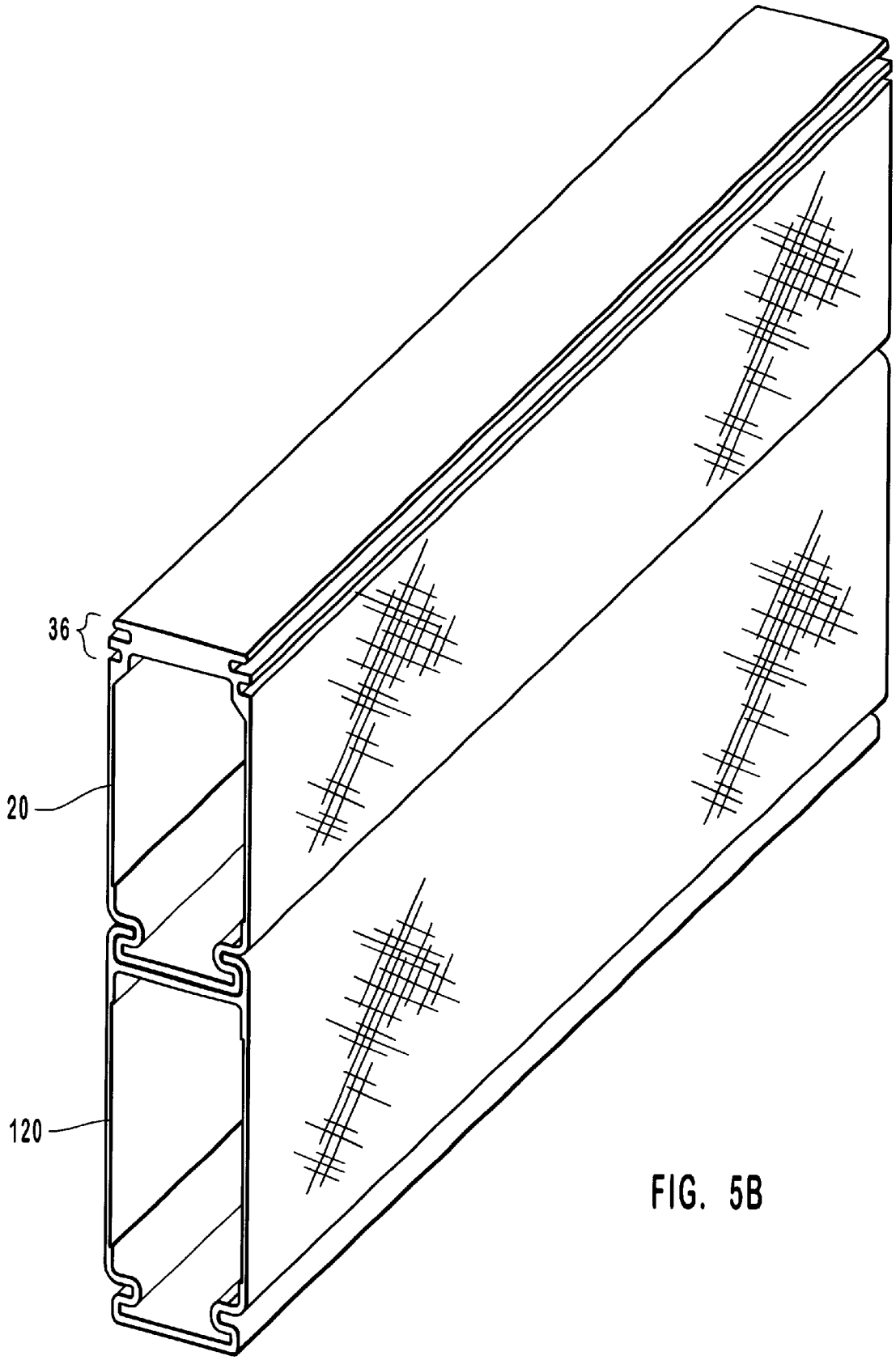
FIG. 5B is a perspective view of an interlocking tongue and groove with a multiple shock absorption tongue.
Figure 6:
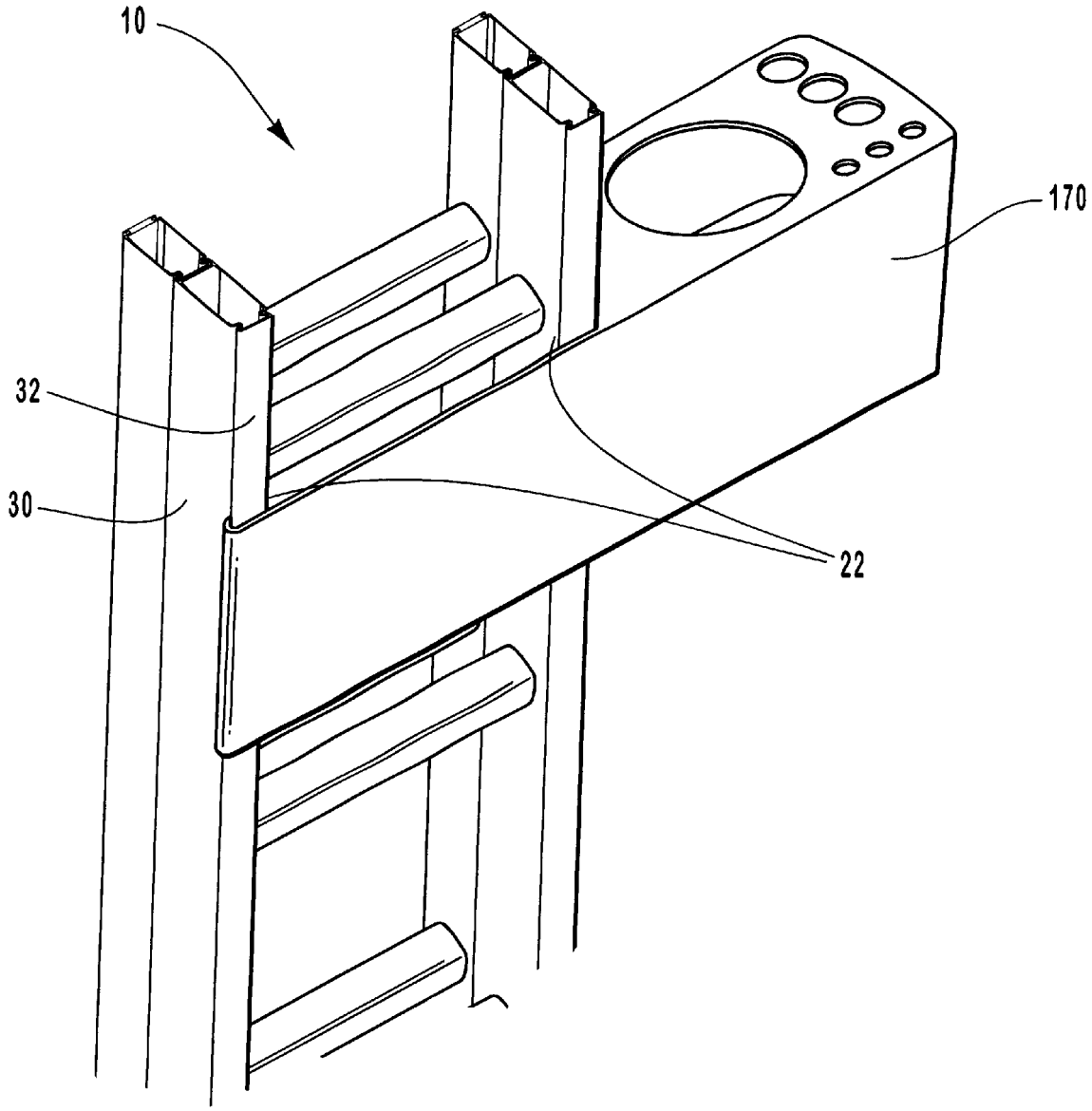
FIG. 6 is a perspective view of an extension ladder with a tongue and groove attachment.

FIG. 5B illustrates a method of enhancing the shock absorbent properties of the tongue configuration. Here baffle 36 is doubled thereby increasing the subsequently increasing the flexural properties of the corresponding rail edge. The flexural properties may be further enhanced by incorporating additional baffles to the tongue configuration. FIG. 6 illustrates a means by which the tongue (or groove) employed as a shock absorbing feature is also employable as a means of attaching various accessories directly to the side rails of a ladder. Where tongue 32 is employed along the outer face of fly rail 30 of a ladder 10, corresponding groove 22 is employed with accessory 170 wherein groove 22 of accessory 170 is engaged with tongue 32 of side rail 30 and affixed thereto by an appropriate clamping device. Although the attachment described is that of a combination paint pail and tool holder, the application of the tongue and groove as a means of attaching an accessory directly to the side rail of a ladder is not limited thereto.

Figure 7:
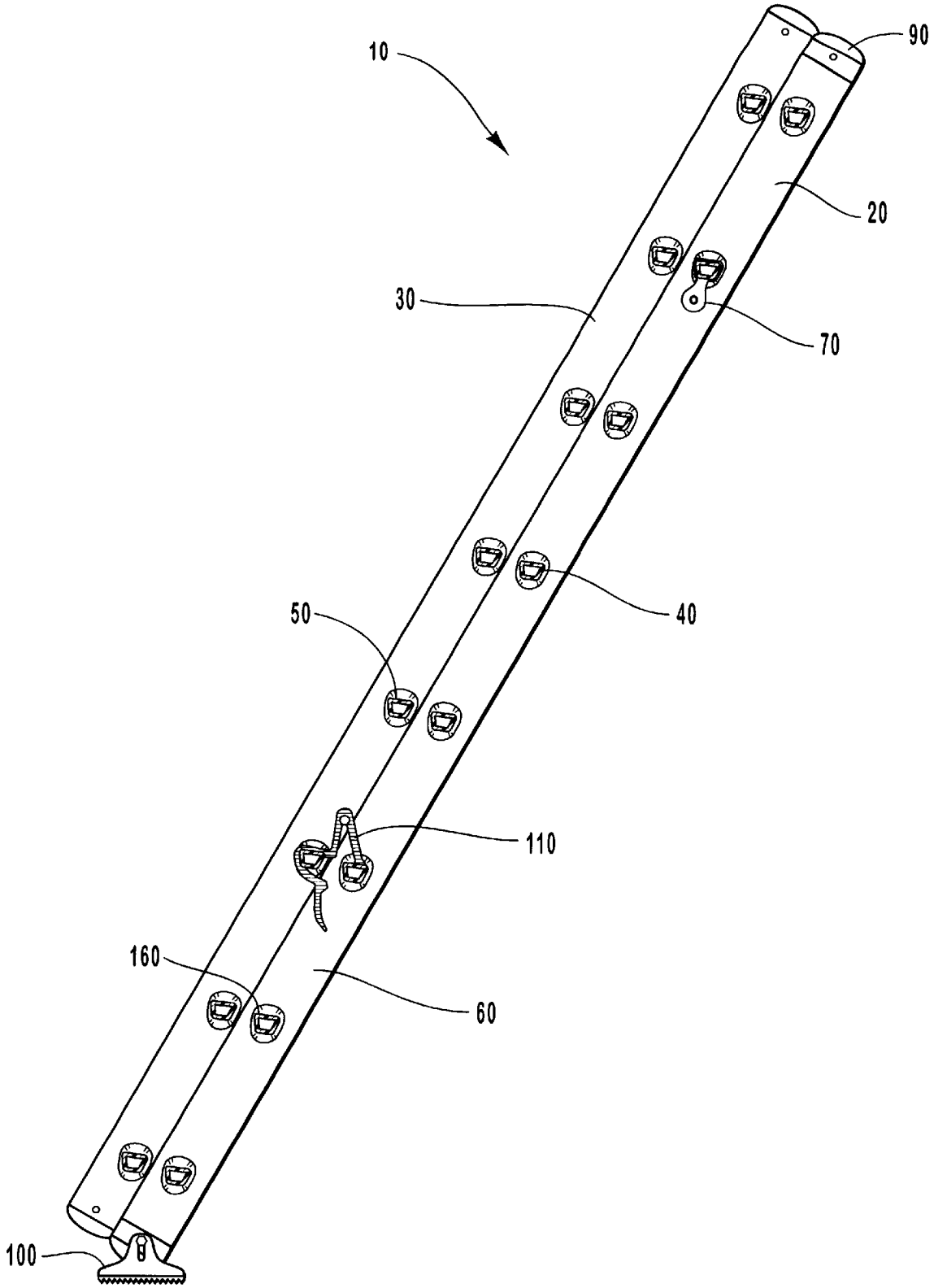
FIG. 7 is a sectional view of a straight extension ladder.

FIG. 7 depicts a cutaway side view of an extension ladder within the invention. Although this illustration relates to extension ladders of the box rail be construed to include extension ladders of other configurations including channeled beam rails. In this illustration the basic ladder 10 is leaned against a vertical surface. Pulley assembly 70 is attached to one of the uppermost base rail rungs 40 and rope 60 is suspended through pulley assembly 70. Rope 60 is extended between the base rail rungs 40 and fly rail rungs 50 to one of the bottommost fly rail rungs to which it is attached by means of rope clamp 160. The other end of rope 60 extends down along the back side of base rail rungs 40 below the bottommost base rail rung 40 and then upwards between base rail rung 40 and fly rail rung 50 where it is attached to the same rail rung as the other end of rope 60 by means of rope clamp 160. Sufficient slack is allowed in rope 60 to avoid excessive friction between rope 60 and bottommost base rail rung 40.

As the latter part of rope 60 is pulled downward, the motion is transmitted through pulley assembly 70 and thereby converted to an upward motion of fly rail 30. Thus, rope 60 takes up its own slack as fly rail 30 slides upward or downward relative to base rail 20.

Figure 8:
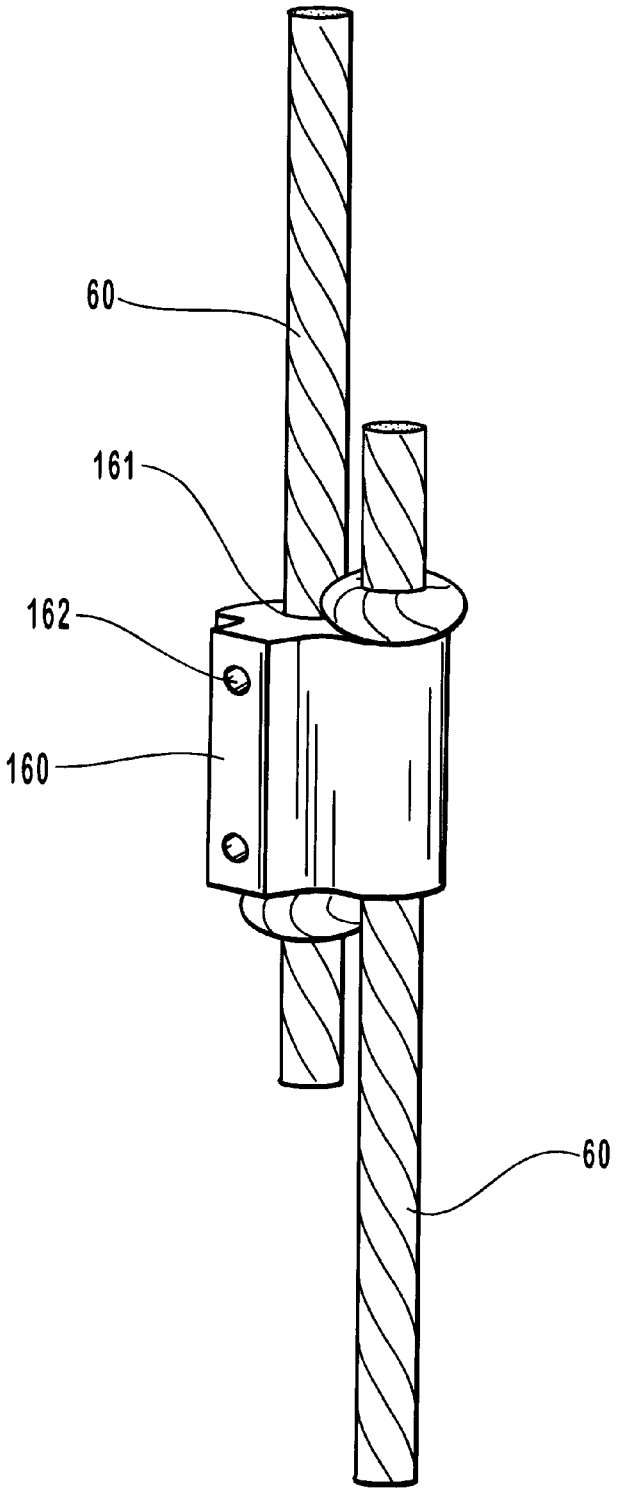
FIG. 8 is a perspective view of a rope clamp.

FIG. 8 depicts one method for attaching rope 60 to fly rail rung 50 (not shown). Rope clamp 160 comprises two rope channels 161 and attachment holes 162. Rope 60 is cut to a prescribed length and one end is passed through pulley 70 (see FIG. 1). A knot is tied in each end of rope 60 and rope 60 is extended through the ladder as previously described. Each rope end is placed counter to the other as illustrated in FIG. 8 and rope clamp 160 is placed over the extended ends as therein illustrated. Each knotted end of rope 60 is herewith captivated by rope clamp 160. Rope clamp 160 is then affixed to the back side of one of the lowermost fly rail rungs 50 by means of attachment holes 162. As that portion of rope 60 that extends downward from pulley assembly 70 is pulled downward, the motion of rope 60 is reversed through pulley assembly 70 and that portion of rope 60 that extends downward and between fly rail rungs 50 and base rail rungs 40 is thereby pulled upward. The captivated end of rope 60 thus exerts an upward force upon fly rail 30. As fly rail upward, the portion of rope 60 that extends downward and behind base rail rungs 40 moves downward. The end of that portion of rope 60 is looped upward around the bottom edge of the lowermost base rail rung 40 and extended upward between the fly and base rail rungs to the same fly rail rung to which the first end of rope was attached. This end of rope 60 is then attached to fly rail rung 50 by means of the same rope clamp 160 previously described. In this manner, the slack in rope 60 created by the upward motion of fly rail 30 is continually taken up around the bottommost base rail rung 40.

As will be appreciated, although the preferred embodiment of the present invention utilizes thermosetting plastics as the matrix binder, this does not preclude the use of other materials such as thermoplastics, ceramics, ceramoplastics or extruded aluminum. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing range of equivalency of the claims are to be embraced within their scope.

What is claimed and desired to be secured by United States Letters Patent is:

1. An extension ladder comprising:

a) at least one pair of box base rails in the general shape of rectangles with a groove formed in one face of said pair of box base rails for the length of its longitudinal axis;

b) at least one pair of box fly rails in the general shape of rectangles with tongues formed in one face of said pair of box fly rails for the length of its longitudinal axis; said pair of box base rails and pair of box fly rails being in a mated relationship with the tongues of the said box fly rails and the grooves of the said box base rails interlocking said box base rails and box fly rails in said mated relationship, wherein the said box fly rails are positioned in a stacked relationship coplanar to the said box base rails such that said face of said box base rail and said face of said box fly rail match, the box fly rails being slidably attached to the box base rails by means of the respective interlocking tongues and grooves, wherein outer edges of at least one of said box base rails and box fly rails opposite to a respective one face comprises a baffle defined by a pair of parallel grooves on each edge and extending along respective said longitudinal axis and forming a tongue to which various ladder attachment may be attached.

2. An extension ladder according to claim 1 comprising a pair of center box base rails in the general shape of a rectangle wherein:

a) interlocking tongue s and grooves are formed in two faces of said center box base rails in such a manner as to slideably interface with respective interlocking tongues and grooves of the box fly rails and base rails for the length of the longitudinal axis and;

b) the box base rails, box fly rails and box center fly rails possess a mated relationship wherein:

1) the said box base, box fly, and box center rails are positioned in a stacked relationship and the said box base, box fly, and box center rails are slideably attached to one another by means of respective interlocking tongues and grooves.

* * * * *